US010246976B2

(12) United States Patent
DeCarlo

(10) Patent No.: US 10,246,976 B2
(45) Date of Patent: Apr. 2, 2019

(54) LINEAR INDUCTION MOTOR PLUNGER LIFT

(71) Applicant: CONOCOPHILLIPS COMPANY, Houston, TX (US)

(72) Inventor: Leonard J. DeCarlo, Richmond, TX (US)

(73) Assignee: ConocoPhillips Company, Houston, TX (US)

( * ) Notice: Subject to any disclaimer, the term of this patent is extended or adjusted under 35 U.S.C. 154(b) by 382 days.

(21) Appl. No.: 15/008,144

(22) Filed: Jan. 27, 2016

(65) Prior Publication Data

US 2016/0312589 A1 Oct. 27, 2016

Related U.S. Application Data

(60) Provisional application No. 62/108,340, filed on Jan. 27, 2015.

(51) Int. Cl.

| | |
|---|---|
| ***E21B 43/00*** | (2006.01) |
| ***E21B 43/12*** | (2006.01) |
| ***E21B 34/06*** | (2006.01) |

(52) U.S. Cl.

CPC ..... *E21B 43/121* (2013.01)

(58) Field of Classification Search

None

See application file for complete search history.

(56) References Cited

U.S. PATENT DOCUMENTS

| | | | | |
|---|---|---|---|---|
| 1,769,637 | A | 7/1930 | Fletcher | |
| 3,602,745 | A * | 8/1971 | Davis | H02K 41/025 310/13 |
| 5,409,356 | A | 4/1995 | Massie | |
| 5,465,789 | A * | 11/1995 | Evans | E21B 43/2401 166/248 |
| 5,957,200 | A | 9/1999 | Majek | |
| 6,209,637 | B1 | 4/2001 | Wells | |
| 6,467,541 | B1 | 10/2002 | Wells | |
| 6,664,880 | B2 * | 12/2003 | Post | B60L 13/04 104/281 |
| 7,270,187 | B2 | 9/2007 | Shulyatikov | |
| 7,373,971 | B2 * | 5/2008 | Montgomery | F04B 17/042 166/369 |

(Continued)

OTHER PUBLICATIONS

Musolino (2012) Tubular Linear Induction Machine as a Fast Actuator: Analysis and Design Criteria, Progress in Electromagnetics Research 132: 603-619 (2012).

(Continued)

*Primary Examiner* — Matthew R Buck
*Assistant Examiner* — Douglas S Wood
(74) *Attorney, Agent, or Firm* — Boulware & Valoir

(57) ABSTRACT

A plunger lift system that uses a linear induction motor instead of gas or fluid pressure to lift the plunger. Electrical voltage is applied to electromagnets installed along the tubing of a wellbore that will induce magnets contained within a special plunger that is introduced inside the tubing to move it and allow it to lift liquids with a piston-like action. The electromotive force may be adjusted by varying the applied voltage as needed to lift the column of liquid from the wellbore or the current reversed to accelerate and optimize plunger descent.

15 Claims, 8 Drawing Sheets

(56) References Cited

U.S. PATENT DOCUMENTS 7,451,823 B2 11/2008 Wilson

OTHER PUBLICATIONS

Plodpradista (2010) Dynamic Performances of Tubular Linear Induction Motor for Pneumatic Capsule Pipeline System, International Journal of Electrical and Computer Engineering 5:4 (2010).
Wang, J., A General Framework for the Analysis and Design of Tubular Linear Permanent Magnet Machines, IEEE Transactions on Magnetics, 35:3 (1999).

* cited by examiner

LINEAR INDUCTION MOTOR PLUNGER LIFT

PRIOR RELATED APPLICATIONS

This application is a US Non-provisional Application, which claims the benefit of and priority to U.S. Provisional Application Ser. No. 62/108,340 filed Jan. 27, 2015. This application is incorporated herein by reference in its entirety for all purposes.

FEDERALLY SPONSORED RESEARCH STATEMENT

Not applicable.

FIELD OF THE DISCLOSURE

The disclosure generally relates to an improved plunger lift system based on linear induction principles.

BACKGROUND OF THE DISCLOSURE

As natural gas is produced from gas wells, the pressure in the formation will decrease, resulting in a reduction in gas flow rate and associated gas velocity. Before the natural drive pressure is reduced, the flow rate and velocity of produced gas may be sufficient to remove the liquids from the well with the gas. However, at some point the flow rate of gas will be insufficient to carry liquids out of the well. As a result, the liquid loading in the well will increase, and liquid will collect in the bottom of the well, further reducing its output.

When production by natural reservoir pressure becomes uneconomical, artificial lift techniques can be utilized to increase well production. A number of artificial lift systems are known in the industry, including sucker rod pumps, gas lift techniques and plunger lift techniques.

A plunger lift is an artificial lift method used to deliquify natural gas wells and high gas-to-liquid ratio oil wells. A plunger is used to remove contaminants from productive natural gas wells, such as water (as a liquid or mist), oil, condensate and wax. FIG. 1 shows a schematic of a typical plunger system. The plunger cycles between the top and bottom of the well to lift fluids to the surface, as illustrated in FIG. 2. A more detailed graphic of a plunger lift system is also in FIG. 3.

The basic function of the plunge lift controller is to open and close the well shutoff valve at the optimum times, to bring up the plunger and the contaminants, and thus maximize natural gas production. A well without a deliquification technique will stop flowing or slow down and become a non-productive well, long before a properly deliquified well will.

Conventional plunger lift systems, which are also known as free piston systems, utilize a plunger (piston). The well is shut in and the plunger falls to the bottom of the tubing and onto a bumper spring, seating nipple or stop near the bottom of the tubing (FIG. 2, "Off Time"). After pressure in the well has built, the wellhead is opened to flow and the high pressure gas located within the well pushes the piston upward to the surface ((FIG. 2, "Lift"), thereby pushing the liquid on top of the plunger to the surface and allowing the well to produce for as long as possible (FIG. 2, "After flow"). This sequence can be repeated by closing the wellhead off and allowing the plunger to fall again to the bottom of the well while pressure in the well is allowed to rebuild.

A number of patents describe plunger lift systems, including U.S. Pat. No. 5,957,200, U.S. Pat. No. 6,209,637, U.S. Pat. No. 6,467,541 and U.S. Pat. No. 7,270,187. However, each of these relates to minor component improvements or materials improvements, and the basic principles remain unchanged since the earliest patents, such as U.S. Pat. No. 1,769,637. Thus, all rely on pressure from the reservoir to provide the energy needed for the lift operation.

What is needed in the art are improved plunger lift systems with improved efficiency, reduced wear characteristics, and reduced reliance on pressure lifting mechanisms.

SUMMARY OF THE DISCLOSURE

The invention generally relates to a plunger lift system, device and uses thereof wherein lift force is provided by linear induction, rather than by pressure.

Linear induction plunger lift is a concept whereby electrical voltage is applied to electromagnets installed along the tubing of a wellbore that will induce magnets contained within a special plunger that is introduced inside the tubing to move it and allow it to lift liquids with a piston-like action. The electromotive force may be adjusted by varying the applied voltage as needed to lift the column of liquid from the wellbore or the current reversed to accelerate and optimize plunger descent. The size and placement of the magnets will also depend on tubing and plunger size, and lift needs.

Direct linear electro-mechanical energy conversion devices offer numerous advantages over their rotary-to-linear counterparts, notably the absence of mechanical gears and transmission systems, which results in a higher dynamic performance and improved reliability. The concept also lends itself to automation for quickly optimizing and maintaining the process at peak efficiency.

Conventional plunger lift systems common to the oil and gas industry typically rely on the pressure of the produced hydrocarbons (gas or liquid) to move the plunger. The proposed system differs in that electromotive force is used to actually move the plunger, allowing the system to operate with little or no in situ producing reservoir energy. No plunger systems of the proposed type currently exist.

With this type of system, currently un-producible wells may actually be pumped free of liquids and restored to production. This process will insure the maximum hydrocarbon recovery from an oil and gas well and capture previously un-producible hydrocarbons.

Linear induction technology is a known concept and is used mainly to provide motive force to maglev trains. A linear motor is an electric motor that has had its stator and rotor "unrolled" so that instead of producing a torque (rotation) it produces a linear force along its length. The most common mode of operation is as a Lorentz-type actuator, in which the applied force is linearly proportional to the current and the magnetic field.

Many designs have been put forward for linear motors, falling into two major categories, low-acceleration and high-acceleration linear motors. Low-acceleration linear motors are suitable for maglev trains and other ground-based transportation applications. High-acceleration linear motors are normally rather short, and are designed to accelerate an object to a very high speed, for example in a coilgun.

In the design of a linear induction motor or LIM, the force is produced by a moving linear magnetic field acting on conductors in the field. Any conductor, be it a loop, a coil or simply a piece of plate metal, that is placed in this field will have eddy currents induced in it thus creating an opposing magnetic field, in accordance with Lenz's law. The two opposing fields will repel each other, thus creating motion as the magnetic field sweeps through the metal. See e.g. FIG. 4.

As with rotary motors, linear motors frequently run on a 3 phase power supply. However, there are end-effects that reduce the force, and the lack of gearboxes means that the secondary will often move relatively slowly. Linear induction motors are thus frequently less energy efficient than normal rotary motors. Nonetheless, LIMs are often used where contactless force is required, where low maintenance is desirable, or where the duty cycle is low.

In the case of this disclosure, the plunger or possible series of plungers represent the train while the tubing represents the track. Compared to a linear induction train track, a series of electromagnets are in this case installed along the production tubing. The plunger(s) itself is designed with e.g., annular electro and/or fixed magnets that are induced by the application of electrical voltage to the tubing or field magnets causing movement of the plunger. The field can also be annular, but like the plunger, magnets do not have to be annular. The repelling and attraction sequence between the tubing or field magnets and the plunger (rotor for a conventional rotary electric motor) magnets creates movement as with a common electric motor. The use of ring or annular magnets allows for an even or centralized application of the magnetic force, minimizing drag and friction effects that would reduce efficiency. However, the same effect could be achieved with other magnet shapes or magnet that are placed equidistantly around the circumference of the tubing and plunger lift device.

One distinct advantage of this plunger lift system is the ability to accelerate the plunger downhole by reversing the current to the field magnets, effectively decreasing the overall cycle time to pump the liquid. Applied voltage may also be adjusted to control the ascent and descent speed and force of the plunger for fine tuning the system. As with conventional plunger lift systems, this process may be automated, even to the point of applying artificial intelligence, to maintain peak efficiency for changing liquid loading conditions. Another feature of this method is that conventional gas pressure (if available) may be used along with the electrical energy to move the plunger, maximizing the amount of energy available to translate the plunger.

U.S. Pat. No. 5,409,356 describes a well pumping system with linear induction motor. However, this system still uses a sucker rod and counterweight, as found in a typical jack pump. Thus, this pump is not suitable for plunger lift operations.

Tubular Linear Induction Motors or TLIMs are known. See e.g., Musolino (2012). However, such technology has never before been applied to plunger lift systems. The plunger lift LIM does not have to be tubular, however, this layout may have beneficial aspects.

As highlighted in FIG. 6, there are numerous variants of tubular linear permanent magnet machines. FIGS. 6(*a*) and (*b*) shows internal and external magnet topologies with radially magnetized magnets, respectively, both of which could be either moving magnet or moving armature. FIG. 6(*c*) shows a topology with axially magnetized magnets separated by iron pole pieces, while FIG. 6(*d*) employs a multi-pole Halbach magnetization.

In all these topologies, the armature could be either air- or iron-cored, in which case it could be either slotless or slotted, while one member may be longer than the other dependent on the required stroke. Generally, the preferred topology depends on the application. Slotted iron-cored topologies usually have a higher force density, but may also produce an undesirable destabilizing tooth ripple cogging force and have the highest eddy current losses in the magnets and the iron, especially when operating at high speed. Slotless armature topologies, on the other hand, eliminate the tooth ripple cogging effect, and thereby improve the dynamic performance and servo characteristic at the expense of a reduction in specific force capability, although the cogging force associated with the finite length of the iron-cored armature may still be significant if it is not designed accordingly.

The TIMPL pumping system described by Plodpradista (2010) can be modified for use in a plunger lift system, by employing a similar motor design, and a typical plunger lift device, such as is shown in FIG. 3. The TLIM capsule pump of Plodpradista consists of two parts: the stator—a pipe section with three-phase windings embedded in laminated ferromagnetic core and the rotor—a two-layer-wall wheeled capsule, with ferromagnetic inner layer and conductive outer layer. The TLIM acting as a capsule pump will allow the capsules free passage through the pump, thereby increasing the system throughput. The Plodpradista design requires modification to allow collection and transport of fluid by the plunger, but such designs are available.

The terms linear induction motor or linear motor is intended to include all similar technology, including LIMs, tubular LIMS, Linear Synchronous Motors (LSMs), homopolar linear motors, and the like, wherein sequentially activated magnetic fields provides a force allowing linear movement.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention, such as instructions for use, sensors, and the like.

The following abbreviations are used herein:

| ABBREVIATION | TERM |
|---|---|
| LIM | Linear induction motor |
| TLIM | Tubular linear induction motor |

DETAILED DESCRIPTION

Figure 1:
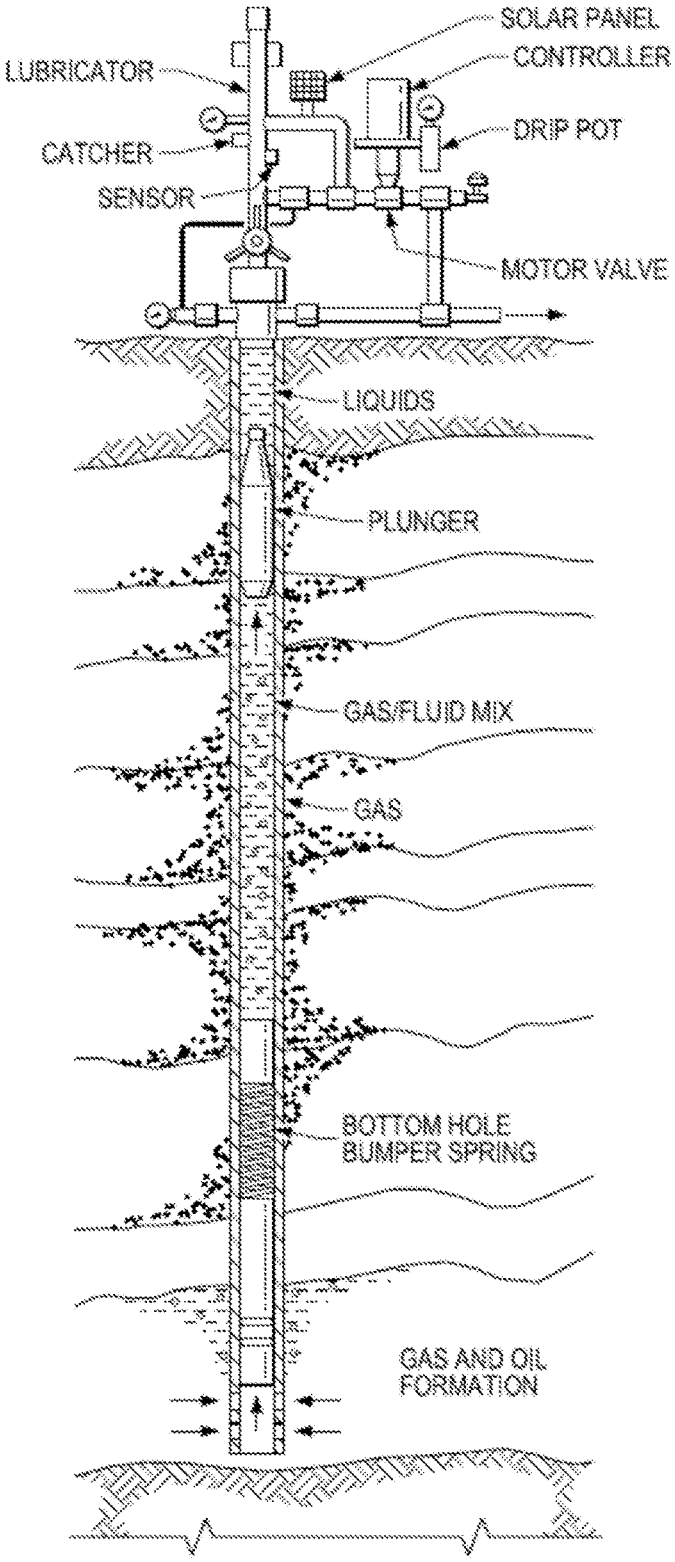
FIG. 1 schematic of a typical plunger lift system, in this case the system from Production Control Systems. LUBRICATOR: Cushions the impact of an arriving plunger and provides safe access to the plunger. CATCHER: Catches and holds the plunger in the lubricator for safe removal. CONTROLLER: Opens and closes the motor valve using time, pressure or flow rate and provides production history for the operator. MOTOR VALVE: Pneumatic diaphragm-activated valve starts and stops the well's production based on input from the controller. SOLAR PANEL: Provides a power source to the controller batteries. DRIP POT: Prevents downtime by trapping and preventing condensate, water and other contaminates from clogging the latch valves. ARRIVAL SENSOR: Signals the plunger's arrival to the controller. PLUNGER: Steel "piston" that acts like a swab, creating a seal to the tubing and lifting liquids and solids (sand, salt, coal fines, paraffin and scale) to the surface. BOTTOM HOLE BUMPER SPRING: Sits above the seating nipple, protecting the plunger upon impact; can also hold a ball and seat to trap liquids in the tubing.
Figure 2:
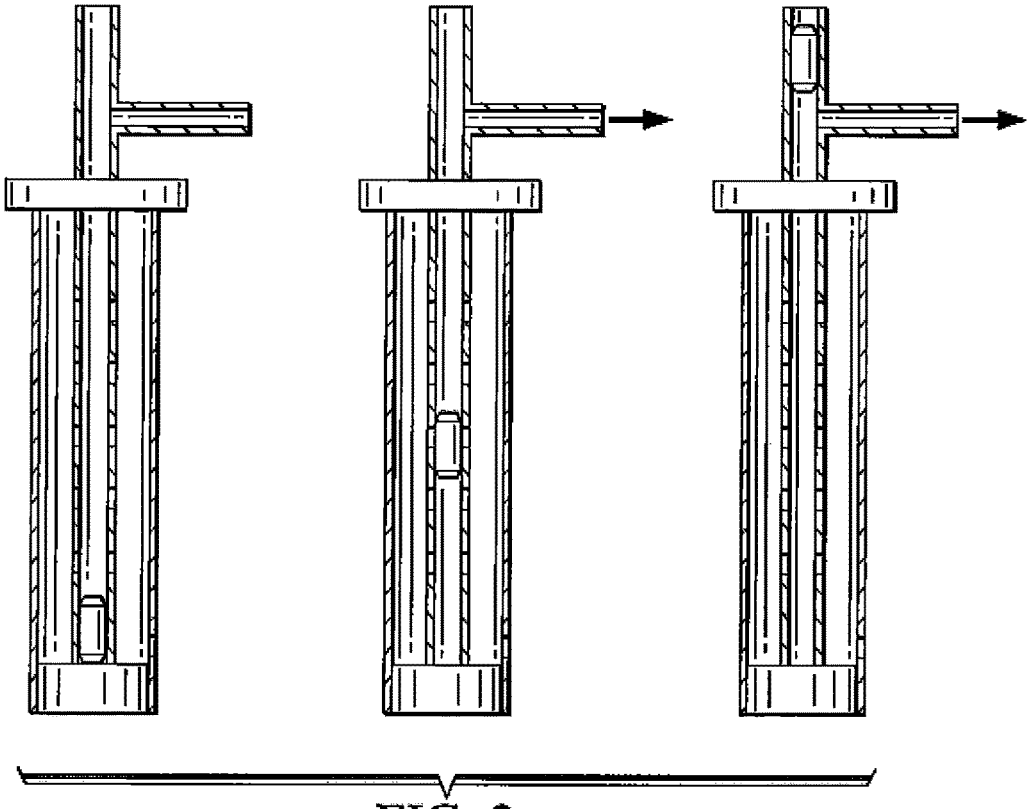
FIG. 2. Schematic of plunger lift stages showing off time where plunger has traveled to the bottom of the well, lift or rise when the well is open to production as the plunger and fluid slug travels to the surface, and afterflow when the well continues to flow after the plunger has arrived at the surface.

The disclosure provides one or more of the following embodiments in any combination thereof:

An improved plunger lift system, the plunger lift system having a cased well, a plunger in the cased well moveable from a stop at the bottom of the cased well to a top of the cased well, thus delivering fluids to a wellhead, wherein plunger lift force is provided by a fluid pressure in said well, wherein the improvement comprises replacing said fluid pressure plunger lift force with a linear induction motor (LIM) plunger lift force.

An improved plunger lift system wherein said LIM is a tubular linear induction motor (TLIM).

An improved plunger lift system wherein said LIM also drives the plunger down said tubing at a speed faster than gravity drop speed.

An improved plunger lift system, wherein the plunger lift system having a tubing positioned in a cased well, a plunger in the tubing moveable from the bottom of the tubing to a top of the tubing, wherein plunger lifting force is provided by fluid pressure buildup in said well, said improvement comprising a linear induction motor inside said well and operatively coupled to said plunger to provide plunger lifting force, said linear induction motor being driven by three phase alternating current.

An improved plunger lift system wherein said LIM is a TLIM.

An improved plunger lift system wherein said TLIM has internal magnet topologies with radially magnetized magnets, or external magnet topologies with radially magnetized magnets, or axially magnetized magnets separated by iron pole pieces or multi-pole Halbach magnetization.

An improved plunger lift system wherein said TLIM further comprising a hollow armature that is slotless.

An improved plunger lift system wherein said TLIM comprises i) a stator being a pipe section with three-phase windings embedded in a laminated ferromagnetic core and ii) a rotor being a two-layer-wall wheeled capsule, with ferromagnetic inner layer and conductive outer layer.

An improved plunger lift system wherein said TLIM also drives the plunger descent at a speed faster than gravity descent.

An improved plunger lift system wherein the LIM or TLIM is computer controlled.

A plunger lift system, comprising: a) a downhole tubing comprising a linear induction motor (LIM), and b) a plunger lift comprising magnets or electromagnets or magnetically responsive materials arranged in circumference around said plunger lift, and c) wherein plunger lifting force is provided by said linear induction motor.

A plunger lift system said LIM comprising individually activatable electromagnetic coils arranged equidistantly around the circumference of said tubing.

A plunger lift system further comprising a processor to control said LIM.

A plunger lift system, said plunger lift comprising permanent annular magnets inside a jacket of said plunger lift.

A plunger lift system comprising first and second plunger lifts devices connected in tandem by a hollow tube allowing fluid from said first plunger lift to said second plunger lift.

Figure 3:
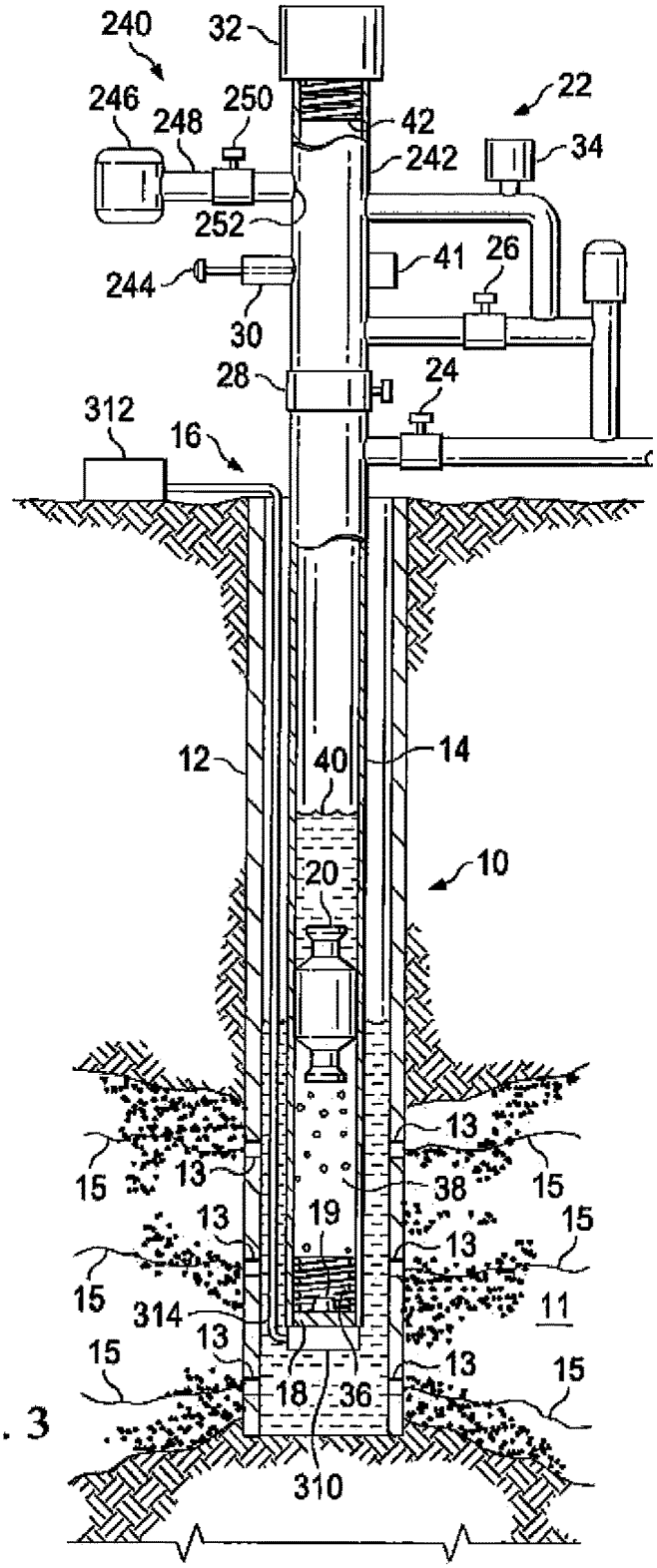
FIG. 3 drawing of an exemplary plunger lift system, from U.S. Pat. No. 7,451,823.
Figure 4:
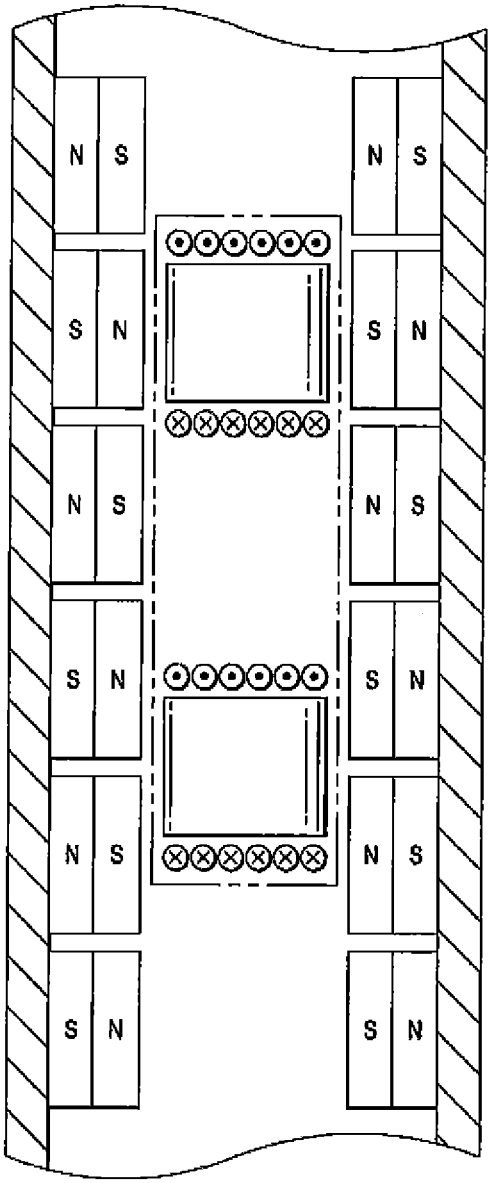
FIG. 4. Free-body diagram of a U-channel synchronous linear motor. The view is perpendicular to the channel axis. The two coils at center are mechanically connected, and are energized in "quadrature" (with a phase difference of 90° ($\pi/2$ radians)). If the bottom coil (as shown) leads are in phase, then the motor will move downward (in the drawing), and vice versa (adapted from wikipedia).
Figure 5:
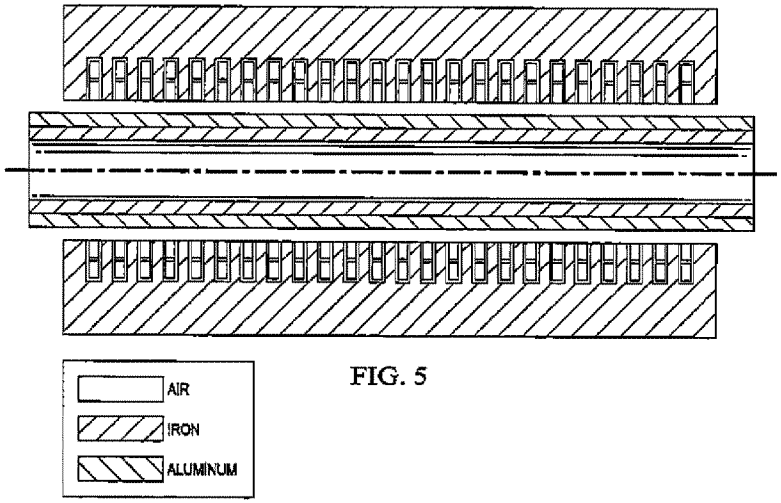
FIG. 5. Schematization of the TLIM with hollowed mover. The armature consists of a conductive nonferromagnetic sheet (aluminum) surrounding an iron tube. The whole armature is free to move in the axial direction on linear bearings (not shown in the figure).
Figure 6A:
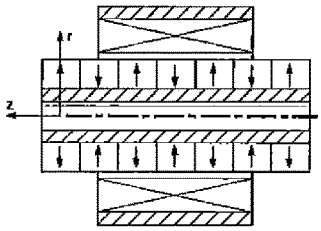
FIG. 6A-D. Typical tubular linear permanent magnet machine topologies: (a) radial magnetization, internal magnet topology, (b) radial magnetization, external magnet topology, (c) axial magnetization, internal magnet topology, and (d) Halbach magnetization, internal magnet topology.
Figure 6B:
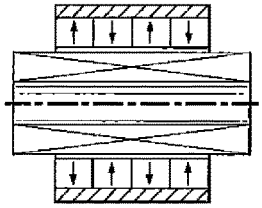
Figure 6C:
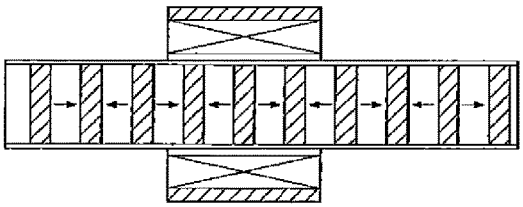
Figure 6D:
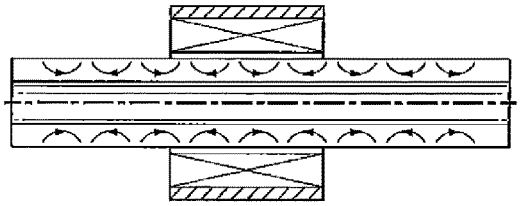
Figure 7A:
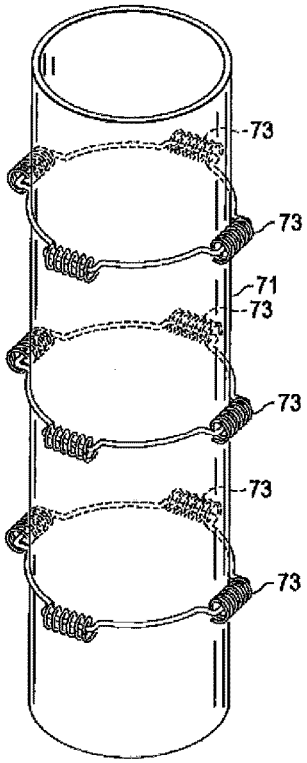
FIG. 7 schematic of plunger lift system with LIM. Borehole tubing with electromagnets on an outer surface thereof shown, as well as plunger lift equipped with external replaceable seals for creating a fluid seal between the lift and the borehole tubing. The plunger lift also has fixed ring magnets in or inside of the outer jacket.
Figure 7B:
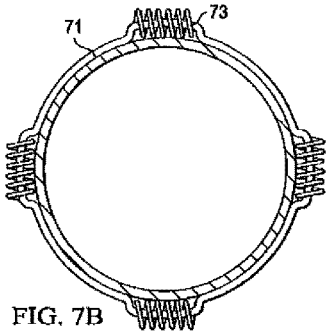
Figure 7C:
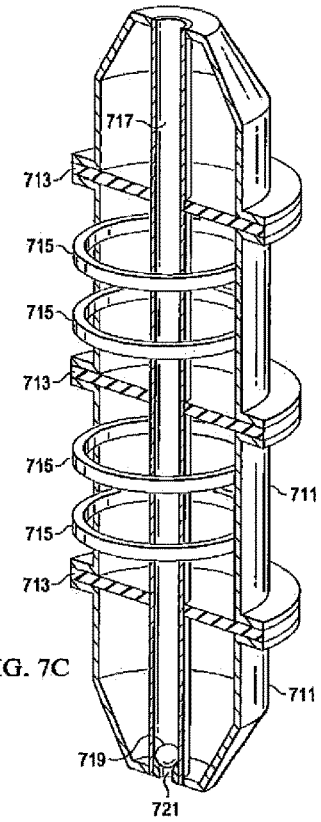
Figure 8A:
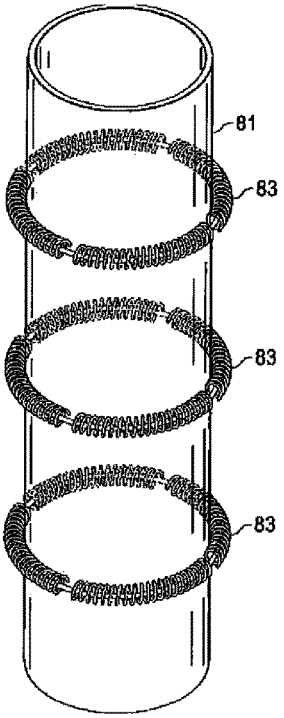
FIG. 8 schematic of plunger lift system with TLIM. There the borehole tubing is fitted with tubular electromagnets.
Figure 8B:
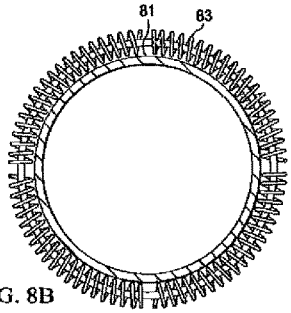
Figure 8C:
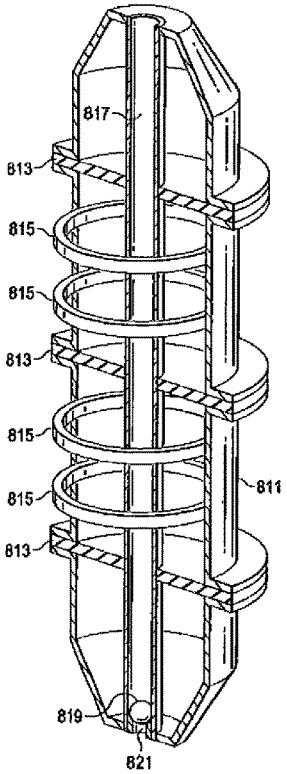
Figure 8D:
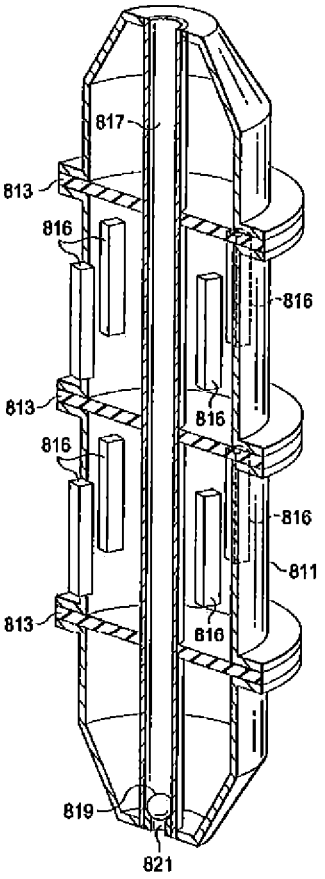
Figure 9:
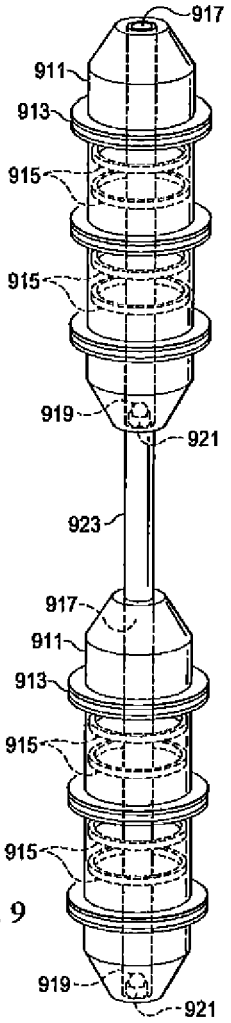
FIG. 9 Plunger lift device variation with tandem plunger lifts.

The invention will now described in additional detail, with respect to the appended drawings:

With reference to FIG. 3, the gas well 17 will have a wellbore 10 located within petroleum-bearing formation 11 and which typically contains a casing 12 either throughout the entire well or a portion of the wellbore. Extending through a portion of the formation 11 may be fractures 15 created by known well stimulation techniques. The wellbore 10 can also contain tubing 14 within the casing 12, in this case modified to include electromagnets as shown in FIGS. 7-9. Typically, casing 12 at the lower end will have one or more perforations 13 to provide a fluid passage between the inside of casing 12 and formation 11.

In a typical arrangement, the well production will flow through the tubing 14 to the wellhead 16. For gas lift operations the tubing 14 can be provided with a stop 18 and seating nipple 19 at the lower end of the tubing 14, and a plunger 20 which travels in the tubing 14, and to the wellhead 16. In a typical arrangement, a manifold 22 is provided at the wellhead 16 which can have a plunger catch 30 to hold the plunger in place, a lubricator 32, and a control box 34 to control the flow of gas and liquid from the well by operating the valves 24, 26, 28 and 250 and related conduits.

Stop 18 is provided to prevent plunger 20 from falling below the position of the stop 18. The stop 18 can include a spring 36 or other shock absorbing device to reduce the impact of the falling plunger 20. The plunger 20 can be of any of the numerous designs known in the art or another delivery system as described herein, but of course modified to include magnets or magnetically responsive materials as shown in FIGS. 7-9. The plunger 20 provides a mechanical interface between the gas 38 and the liquid 40 present in the well. After shutting the well off at the surface, plunger 20 is allowed to fall to the bottom of the well and rest on the stop 18. After pressure builds in wellbore 10, well 17 is opened and the magnets activated in sequence to lift/push the plunger 20 and liquid 40 on top of plunger 20 up the tubing 14 to the surface.

When plunger 20 reaches the top of well 17 it enters or is received by manifold 22. Manifold 22 can include a shock absorbing spring 42 or other mechanism to reduce the impact of the plunger. A plunger arrival sensor 41 is provided to detect arrival of the plunger 20 at the surface and to activate plunger catch 30, which holds the plunger 20 until a signal is received to release plunger 20. Control box 34 contains circuitry for opening and closing the appropriate valves 24, 26, 28, and 250 during the different phases of the lift process, and for controlling magnet activation.

As known in the art, other valving/piping arrangements may be constructed to accomplish the same functions. By controlling the magnets and/or valves, control box 34 regulates the plunger lift cycle and the application of various materials such as treatment chemicals, surfactants, or lubricants, and, in the present invention, a foaming agent, to the plunger. Furthermore, once arrival sensor 41 signals control box 34 that plunger 20 has been caught by plunger catcher 30, appropriate materials may be applied to plunger 20 and/or dispensers attached to plunger 20. Following application of chemicals, control box 34 may also release plunger 20 according to its control method.

The above design is modified in FIG. 7 to include a linear induction motor. A top view of the borehole tubing 71 is seen with electromagnets 73, in this case 4, arranged equidistantly around the tubing 71. The tube could have two or three or more than 4 electromagnets, as needed for lift capacity. The plunger lift device includes an outer jacket 711, e.g., of aluminum, around which are fitted seals 713, preferably of an elastomeric material resistant to degradation by petroleum. Inside the jacket are fixed permanent ring magnets 715, which will interact with the electromagnets 73 in the borehole tubing 71 to create the lift. Jacket 711 has an interior fluid passage 717 for hydrocarbon passage. At the bottom of the lift plunger is a valve or other flow controller, in this case a check valve comprising a ball 719 and seat 721, as is typical in the art.

FIG. 8 is similar, but tubing 81 is equipped with tubular LIMs 83, here shown as four electromagnets, but which can be one or more. The lift plunger parts include the jacket 811, seals 813, ring magnets 815, fluid passageway 817, ball 819 and seat 821. In a variation of the lift plunger bar magnets 816 are shown inside the jacket 811.

FIG. 9 shows a tandem lift plunger, wherein the parts include the jacket 911, seals 913, magnets 915, fluid passageway 917, ball 919 and seat 921 connected to hollow connecting rod or tube 923 that is then connected to a second tandem lift plunger. Such design allows larger offset profiles in the tubing string, such as a side pocket gas lift mandrel, to be passed without stalling the plunger assembly, since the second lift plunger can maintain the seal, as the first plunger reaches the larger diameter tubing area and loses it pressure seal. By the time the second plunger reaches the larger diameter tubing, the first plunger will again be sealed. In some embodiments, the connector tube 923 is of adjustable length, thus accommodating various distances that need be traversed.

Plungers can also be adjustable in the sense of allowing a controlled bypass of gas through the fluid passageway if excess gas is produced by the well for optimum plunger operation. Such design would not use a check valve (ball and seat), but an orifice or small control valve to allow gas escape when a pressure limit in reached. This configuration is known in the art as a "bypass lift plunger" and is equally applicable to be configured for use with an LIM or TLIM.

The following citations are incorporated by reference herein in their entireties for all purposes:

U.S. Pat. No. 7,451,823
U.S. Pat. No. 5,957,200,
U.S. Pat. No. 6,209,637,
U.S. Pat. No. 6,467,541,
U.S. Pat. No. 7,270,187,
U.S. Pat. No. 5,409,356
Musolino A., et al, TUBULAR LINEAR INDUCTION MACHINE AS A FAST ACTUATOR: ANALYSIS AND DESIGN CRITERIA, Progress In Electromagnetics Research 132: 603-619 (2012), available online at http://www.jpier.org/PIER/pier132/31.12091506.pdf
Wang, J., A General Framework for the Analysis and Design of Tubular Linear Permanent Magnet Machines EEE Transactions On Magnetics, 35:3 (1999), available online at http://eprints.whiterose.ac.uk/852/1/wangjb15.pdf
Plodpradista W., Dynamic Performances of Tubular Linear Induction Motor for Pneumatic Capsule Pipeline System International Journal of Electrical and Computer Engineering 5:4 (2010), available online at http://www.wase-t.org/journals/ijece/v5/5-4-36.pdf.

What is claimed is:

1. A plunger lift system, comprising:

a) a downhole tubing comprising a linear induction motor (LIM), and b) a plunger lift device comprising magnets or electromagnets or magnetically responsive materials arranged in circumference around said plunger lift, and c) wherein a lifting force for said plunger lift device is provided by said linear induction motor wherein said plunger lift device comprising first and second plunger lifts devices connected in tandem by a hollow tube allowing fluid from said first plunger lift to said second plunger lift.

2. The plunger lift system of claim 1, wherein said LIM is a tubular linear induction motor (TLIM).

3. The plunger lift system of claim 1, wherein said LIM also drives the plunger down said tubing at a speed faster than gravity drop speed.

4. The plunger lift system of claim 1 wherein the downhole tubing is positioned in a cased well, the plunger in the tubing moveable from the bottom of the tubing to a top of the tubing, wherein lifting force is provided by fluid pressure buildup in said well, and wherein the linear induction motor is driven by a three phase alternating current.

5. The plunger lift system of claim 2, wherein said TLIM has internal magnet topologies with radially magnetized magnets.

6. The plunger lift system of claim 2, wherein said TLIM has external magnet topologies with radially magnetized magnets.

7. The plunger lift system of claim 2, wherein said TLIM comprises axially magnetized magnets separated by iron pole pieces.

8. The plunger lift system of claim 2, wherein said TLIM comprises multi-pole Halbach magnetization.

9. The improved plunger lift system of claim 2, said TLIM further comprising a hollow armature that is slotless.

10. The plunger lift system of claim 2, wherein said TLIM also drives the plunger descent at a speed faster than gravity descent.

11. The plunger lift system of claim 4, wherein the LIM is computer controlled.

12. The plunger lift system of claim 1, said LIM comprising individually activatable electromagnetic coils arranged equidistantly around the circumference of said tubing.

13. The plunger lift system of claim 1, said system further comprising a processor to control said LIM.

14. The plunger lift system of claim 1, said plunger lift device comprising permanent annular magnets inside a jacket of said plunger lift device.

15. An improved plunger lift system, wherein the plunger lift system having a tubing positioned in a cased well, a plunger in the tubing moveable from the bottom of the tubing to a top of the tubing, wherein lifting force is provided by fluid pressure buildup in said well, said improvement comprising a tubular linear induction motor (TLIM) inside said well and operatively coupled to said plunger to provide lifting force, said TLIM being driven by three phase alternating current, wherein said TLIM comprises i) a stator being a pipe section with three-phase windings embedded in a laminated ferromagnetic core and ii) a rotor being a two-layer-wall wheeled capsule, with ferromagnetic inner layer and conductive outer layer.

* * * * *